US008126523B2

(12) United States Patent
Bernstein et al.

(10) Patent No.: US 8,126,523 B2
(45) **Date of Patent: *Feb. 28, 2012**

(54) USE OF SUPERCONDUCTOR COMPONENTS IN THIN LAYERS AS VARIABLE INDUCTANCE AND DEVICES INCLUDING SAID COMPONENTS AND CORRESPONDING CONTROL METHOD

(75) Inventors: Pierre Bernstein, Villiers le Sec (FR); Jean-François Hamet, Anguerny (FR); Laurence Mechin, Caen (FR); Nabil Touitou, Gieres (FR); Séverine Mouchel, Tourlaville (FR)

(73) Assignee: Centre National de la Recherche Scientifique, Cedex (FR)

( * ) Notice: Subject to any disclaimer, the term of this patent is extended or adjusted under 35 U.S.C. 154(b) by 1066 days.

This patent is subject to a terminal disclaimer.

(21) Appl. No.: 11/795,422

(22) PCT Filed: Jan. 13, 2006

(86) PCT No.: PCT/FR2006/000072

§ 371 (c)(1),
(2), (4) Date: Jul. 17, 2007

(87) PCT Pub. No.: WO2006/075098

PCT Pub. Date: Jul. 20, 2006

(65) Prior Publication Data

US 2008/0119363 A1 May 22, 2008

(30) Foreign Application Priority Data

Jan. 17, 2005 (FR) ..... 05 00454

(51) Int. Cl.
*H01F 21/00* (2006.01)
*H01P 1/203* (2006.01)

(52) U.S. Cl. ..... 505/211; 505/210; 505/201; 505/202; 505/700; 505/701; 333/99 S; 333/156

(58) Field of Classification Search ..... 505/210, 505/211, 700, 701, 833, 866, 201, 202, 191; 333/99 S, 156, 219, 238.246
See application file for complete search history.

(56) References Cited

U.S. PATENT DOCUMENTS

| | | | | |
|---|---|---|---|---|
| 2,858,463 | A | | 10/1958 | Koda et al. |
| 3,717,773 | A | * | 2/1973 | Parmentier et al. ..... 327/528 |
| 4,558,295 | A | | 12/1985 | Olmsted et al. |
| 5,329,225 | A | | 7/1994 | Roshen et al. |
| 5,426,409 | A | | 6/1995 | Johnson |

(Continued)

OTHER PUBLICATIONS

Jean-Christophe Ginefri; Small superconducting surface coil for NMR imaging at 1.5 Tesla; Travaux Universitaires—These nouveau doctorat 1999, [Note(s): 176] (98 ref.) (Annee de soutenance: 1999) (No. 99 PA11 2355), 2 pp.

*Primary Examiner* — Stanley Silverman
*Assistant Examiner* — Kallambella Vijayakumar
(74) *Attorney, Agent, or Firm* — Greer, Burns & Crain, Ltd.

(57) ABSTRACT

Use, as a component with variable inductance which is a function of the current passing through it, of an inductive superconductive component having at least two terminals and comprising at least one line segment working with said terminals and integrating at least one of these terminals, this line segment constituting a conductive or superconductive layer within a stack of films alternately superconductive and insulating.

21 Claims, 11 Drawing Sheets

U.S. PATENT DOCUMENTS 5,694,134 A 12/1997 Barnes
5,872,489 A 2/1999 Chang et al.
6,066,598 A * 5/2000 Ishikawa et al. ..... 505/210
6,211,753 B1 4/2001 Leifso et al.
6,556,415 B1 4/2003 Lee et al.
6,841,435 B2 1/2005 Udagawa et al.
7,633,356 B2 * 12/2009 Hamet et al. ..... 333/99 S

* cited by examiner

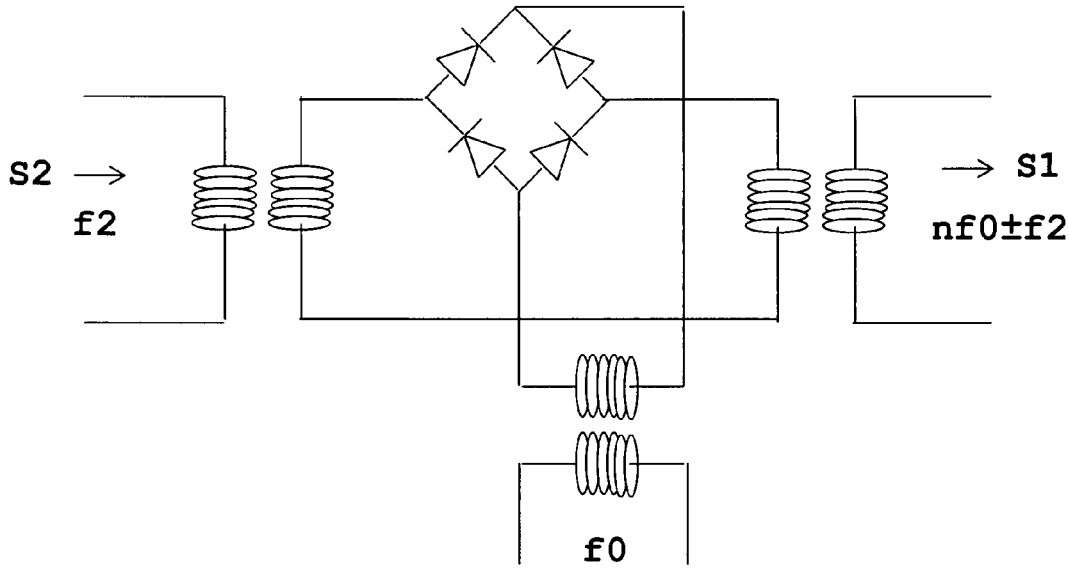
Fig.17
Fig.18
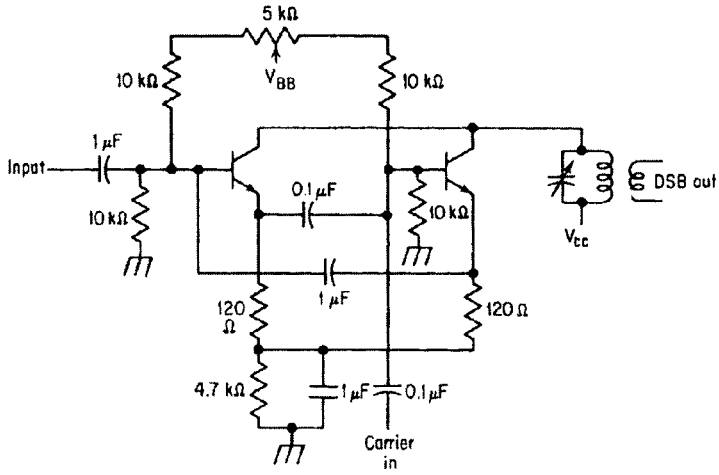

USE OF SUPERCONDUCTOR COMPONENTS IN THIN LAYERS AS VARIABLE INDUCTANCE AND DEVICES INCLUDING SAID COMPONENTS AND CORRESPONDING CONTROL METHOD

This invention relates to a use of a superconductive component in thin layers as variable inductance. It also relate to devices implementing such a use as well as a method for controlling the inductance of such a component.

This invention belongs to the field of electric and electronic superconductive components for the electrical engineering or electronics sectors, the telephony sector, the antennae and high-frequency components sectors. These components are useful in particular for medical imaging, radars and defence electronics, mobile telephony, as well as television or communication by satellite.

Thin-film superconductive inductive components are generally produced by depositing a superconductive film, generally by vacuum methods such as cathode sputtering or pulsed laser ablation, then the definition by lithographic photography of one or more spiral turns. In this technique the size of the device increases with the value of its inductance.

A practical embodiment consists of a spiral coil comprising 5 turns, the external diameter of which is 15 mm, with tracks of 0.4 mm in width at intervals of 0.3 mm having an inductance of 2.12 pH, which is described in the thesis memorandum proposed by Jean-Christophe Ginefri on 16 Dec. 1999 at the Université de Paris XI and entitled <<Antenne de surface supraconductrice miniature pour l'imagerie RMN à 1.5 Tesla>>

The technique described above has two main drawbacks:

- the surface occupied by each inductive component is significant. For example, the component described in the preceding paragraph occupies a surface of more than 700 $mm^2$:
  - if the component is integrated into a circuit, it is often necessary to connect the end of the inner turn to a superconductive line.

This involves a complex method comprising after the depositing and the etching of the turns:

a) the depositing and etching of an insulating film, b) the depositing and etching on this insulator of a second superconductive film having properties similar to those of the first film. This last step is particularly delicate as it is necessary to produce an epitaxial regrowth, a technique which is difficult to control. Other methods allowing the depositing of a coil in thin layers exist, but they present production problems identical to those described here.

On the other hand, these techniques cannot obtain inductive components whose inductance characteristics are easily variable, once implanted in a circuit or an electrical or electronic device.

Now, it can be very useful to have inductive components available the inductance of which can be varied after implanting, for example to carry out a calibration, a measurement, a tuning or an adjustment within an appliance including such components.

Known devices or methods to achieve this often use an adjustment or a tuning of this inductance by modification of the geometry by a mechanical action. This involves, for example, adjusting or correcting the position of a ferrite core inside a coil as in the patent U.S. Pat. No. 4,558,295, or a metal electrode between two dielectric parts as described in the patent U.S. Pat. No. 6,556,415 in the case of a resonant circuit. It can also involve a shift of contact on a conductive track forming a meander deposited in a thin layer, as taught by the US patent application 2002/01 90835.

It is also possible to join by electric or electronic connection a certain number of sub-components of known inductance, as the U.S. Pat. No. 5,872,489 proposes, which has obvious limits, for example in terms of number of values obtained and complexity of production.

Another method is proposed by the U.S. Pat. No. 5,426,409, which consists in controlling by means of a variable current the degree of magnetic saturation of the core of a coil. When the constraints and the frequencies concerned allow, it is also possible to adjust an inductance by means of frequency variation on a semi-conductor material (MESFET GaAs technology, described in U.S. Pat. No. 6,211,753). This type of solution is not however applicable in every case, and is also cannot always be miniaturized beyond a certain limit.

With known solutions, the components obtained can be subject to wear. They are often of not inconsiderable size. They also have limitations concerning the ranges of frequency and/or usable performances. Moreover, they are often difficult to build into circuits manufactured industrially and at low cost.

One purpose of this invention is to entirely or partially overcome these disadvantages.

In the French patent application No. 03 09212 of 28 Jul. 2003, the authors of this invention propose a method for producing an inductive superconductive component in thin layers, with good performances in terms of inductance value as well as regarding miniaturisation and integration.

This inductive superconductive component has at least two terminals and comprises at least one line segment integrating at least one of these terminals, this line segment constituting a conductive or superconductive layer within a stack of alternately superconductive and insulating films.

More particularly, this line segment may consist of a superconductive line passing through the component and on which this stack is deposited.

During development and tests of this type of component, under certain conditions, the inventors have observed an inductive behaviour where the inductance varies when the intensity of a current passing through this component varies.

This invention proposes to use, as a component with variable inductance which is a function of the current passing through it, an inductive superconductive component having at least two terminals and comprising at least one line segment integrating at least one of these terminals, this line segment constituting a conductive or superconductive layer within a stack of alternately superconductive and insulating films.

In the same spirit, the invention proposes an electronic device comprising at least one such superconductive inductive component with variable inductance which is a function of the current passing through it, said superconductive inductive component having at least two terminals and comprising at least one line segment integrating at least one of these terminals, this line segment constituting a conductive or superconductive layer within a stack of alternately superconductive and insulating films.

According to a first embodiment, the invention proposes such a use in which the value of the inductance of the superconductive inductive component is modified or controlled by current control means acting on a direct current which passes through said component.

The invention proposes in particular a method for controlling the inductance of a superconductive inductive component, this superconductive inductive component having at least two terminals and comprising at least one line segment integrating at least one of these terminals, this line segment constituting a conductive or superconductive layer within a stack of alternately superconductive and insulating films, this component being subjected to an alternating voltage or current, this method comprising an injection of an approximately continuous control current, with superimposition of the alternating current passing through said superconductive inductive component.

In this embodiment, a device according to the invention comprises at least one superconductive inductive component which is passed through by an alternating current. This device also comprises means for controlling or modifying the value of the inductance of said superconductive inductive component, these means acting on the intensity of a direct current passing through said superconductive inductive component and being superimposed on the alternating current.

In such a device, the superconductive inductive component may be used in an electronic circuit producing a frequency filtering, at least one characteristic of which is modified by modification of the inductance of said superconductive inductive component.

The superconductive inductive component may also be used in an electronic circuit producing a delay line, at least one characteristic of which is modified by modification of the inductance of said superconductive inductive component.

More particularly, the superconductive inductive component may be used in an electronic circuit producing an antenna manufactured from a superconductive thin film, at least one characteristic of this antenna being controlled or modified by modification of the inductance of said superconductive inductive component.

The invention then also proposes a phase shift radar device comprising a plurality of antennae each comprising an electronic circuit including at least one delay line, this delay line being arranged such that each of said antennae transmits or receives a signal the phase of which is shifted relatively to that of the neighbouring antennae, this configuration being controlled by modification of the inductance of said superconductive inductive component.

Furthermore, in numerous applications it can be useful to have a process available which modifies certain characteristics of one or more waves bringing into play an alternating current, in particular to process a component of this wave when this component represents a signal carrying data.

Another purpose of the invention is then to use these variations of inductance in order to produce new electronic processes or in order to produce, in a new way, electronic processes which were produced in the state of the art in a very different manner or with other types of components.

According to a second embodiment, the invention also proposes such a use in which the superconductive inductive component is subjected to an undulating voltage or current constituting at least one wave, to which it reacts with an inductive behaviour varying within a single period of this wave, this variation producing a modification of at least one characteristic of this wave.

In this embodiment, a device according to the invention comprises at least one such superconductive inductive component which is subjected to an undulating voltage or current constituting at least one wave, to which said component reacts within a single period of this wave, this variation producing a modification of at least one characteristic of this wave.

More particularly, the invention proposes such a use in order to produce a frequency mixer, as well as a device implementing this use.

Within this mixer, at least one such superconductive inductive component is subjected to:

on the one hand, an input wave comprising at least one first component constituting a signal, termed input signal, at a first frequency, termed high frequency, and on the other hand a regular wave at an oscillation frequency close to the high frequency.

The inductive behaviour of said superconductive inductive component then produces an output wave comprising at least one second undulating component at a second frequency, termed low frequency, equating approximately to the high frequency reduced by the oscillation frequency, said second component constituting an output signal dependent on the input signal.

According to one feature, such a mixer comprises at least one superconductive inductive component mounted in parallel with an oscillator component.

According to another feature, such a mixer comprises at least one oscillator component in parallel, as well as a superconductive inductive component in series mounted downstream and to the output of which at least one capacitive and inductive assembly is connected producing a low pass filter.

The invention also proposes a system for receiving an electromagnetic signal of a Hertzian transmission comprising such a mixer.

In the same spirit, the invention also proposes such a use in order to produce a frequency modulator, as well as a device implementing this use.

Within this modulator, at least one such superconductive inductive component is subjected to:

on the one hand, an input wave comprising at least one first component constituting an input signal at a first frequency, termed low frequency, and on the other hand, a regular wave at an oscillation frequency.

The inductive behaviour of said superconductive inductive component then produces an output wave comprising at least one second undulating component at a second frequency, termed high frequency, equating approximately to the sum of the low frequency and the oscillation frequency, said second component constituting an output signal dependent on the input signal.

According to one feature, such a modulator comprises at least one oscillator component in parallel, as well as a superconductive inductive component in series mounted downstream and to the output of which at least one capacitive and inductive assembly is connected producing a high pass filter.

The invention then proposes a system for transmitting an electromagnetic signal of a Hertzian transmission comprising such a modulator.

Thus, the invention proposes an audiovisual broadcasting system, or a communication system, or a satellite system, using at least one of these devices.

Other advantages and characteristics of the invention will become apparent on examination of the detailed description of embodiments which is in no way limitative, and the attached diagrams, in which.

Figure 10:
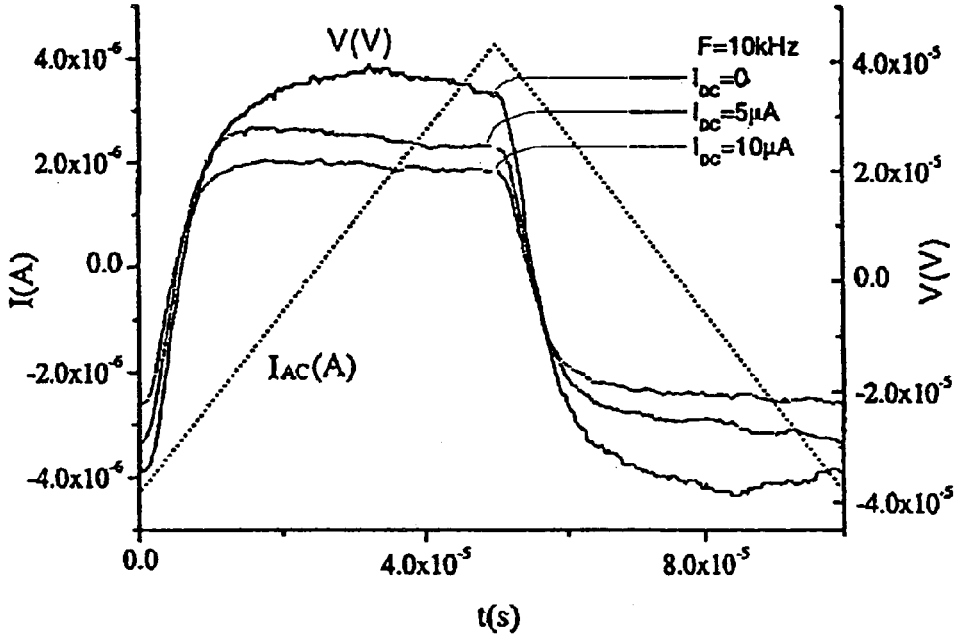

FIG. 10 is a curve representing the value of the potential difference measured between the studs V1 and V2 as a function of time, when a sawtooth alternating current $I_{AC}$ (dotted line) at a frequency of 10 kHz circulates in the sample, in the case where a direct current $I_{DC}$ is also circulating in the sample, and for strengths of this direct current $I_{DC}$ equalling 0 A, 5 μA, and 10 μA respectively.

Figure 11:
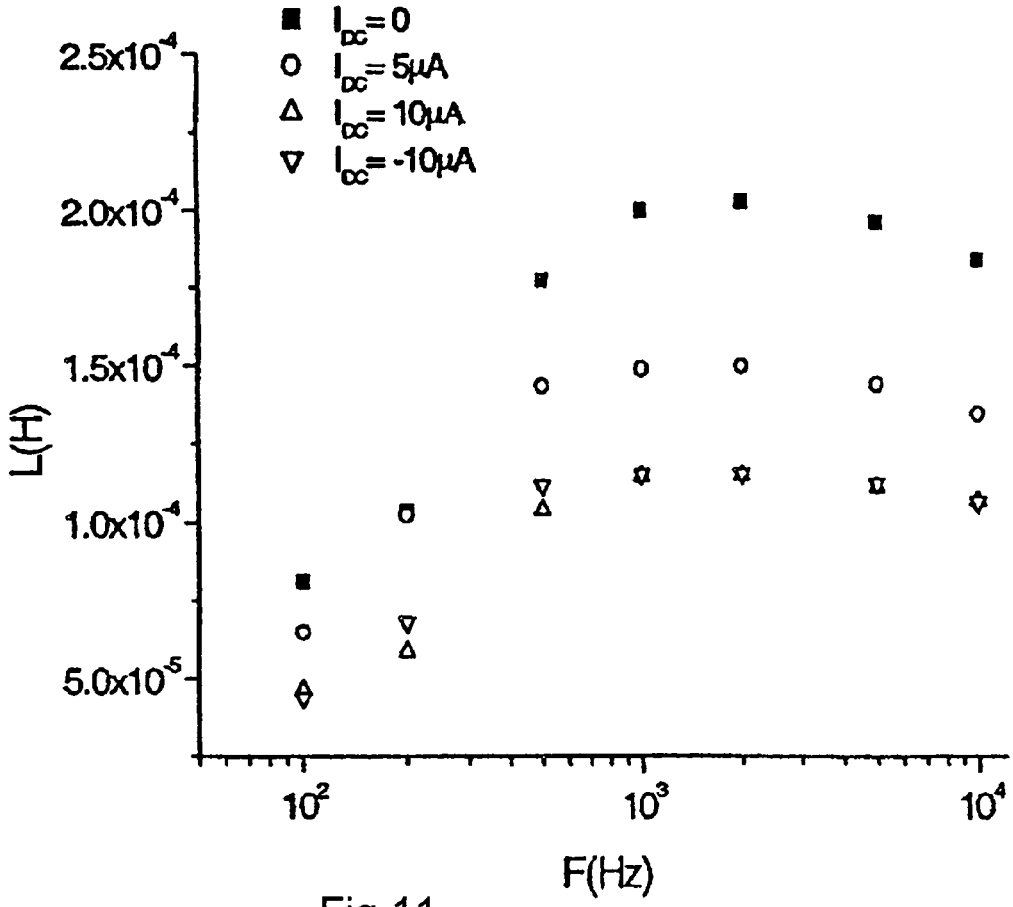
Figure 12:
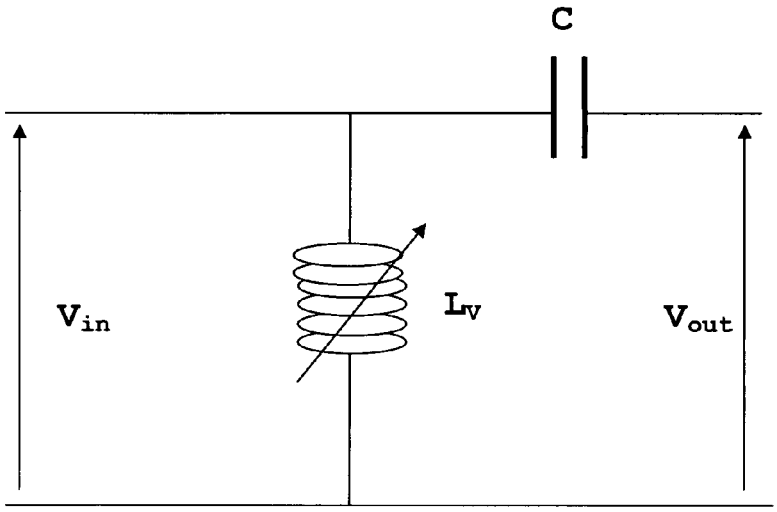
Figure 13:
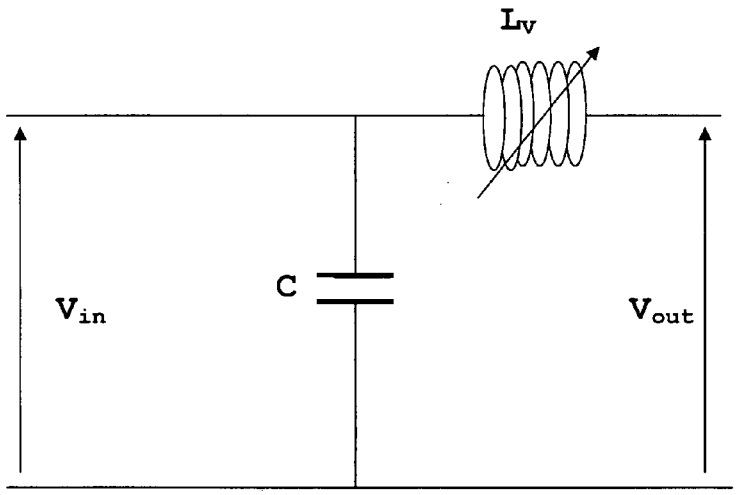
Figure 14:
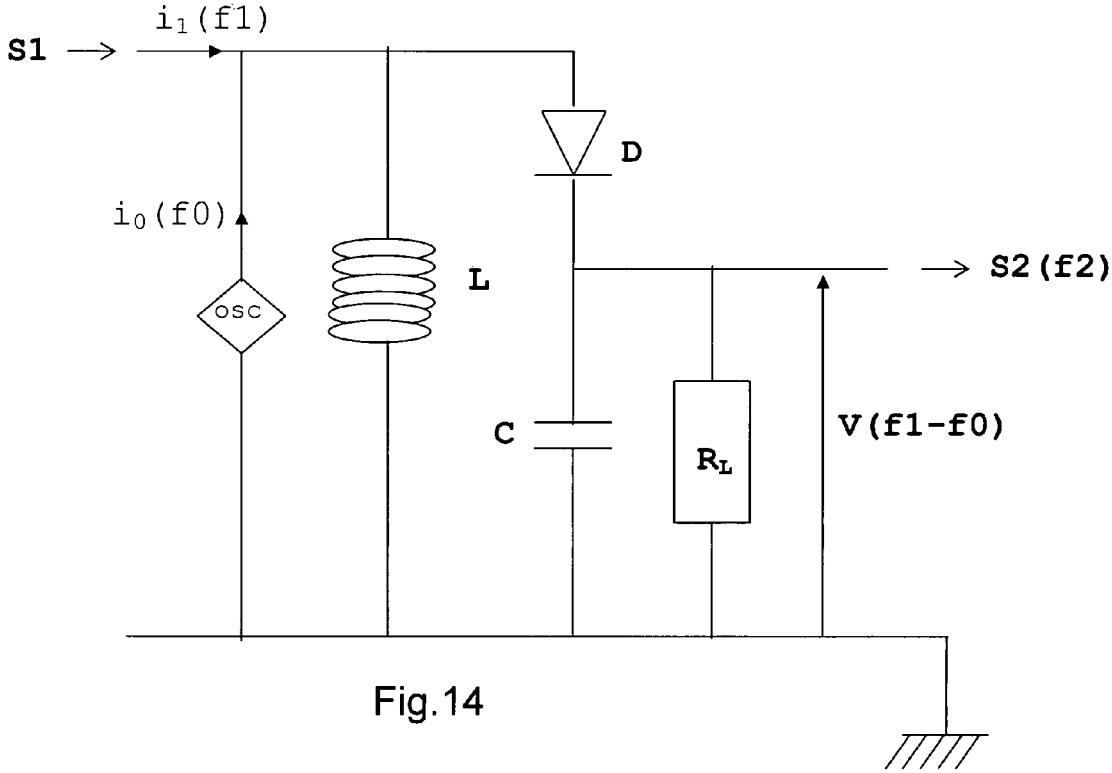
Figure 15:
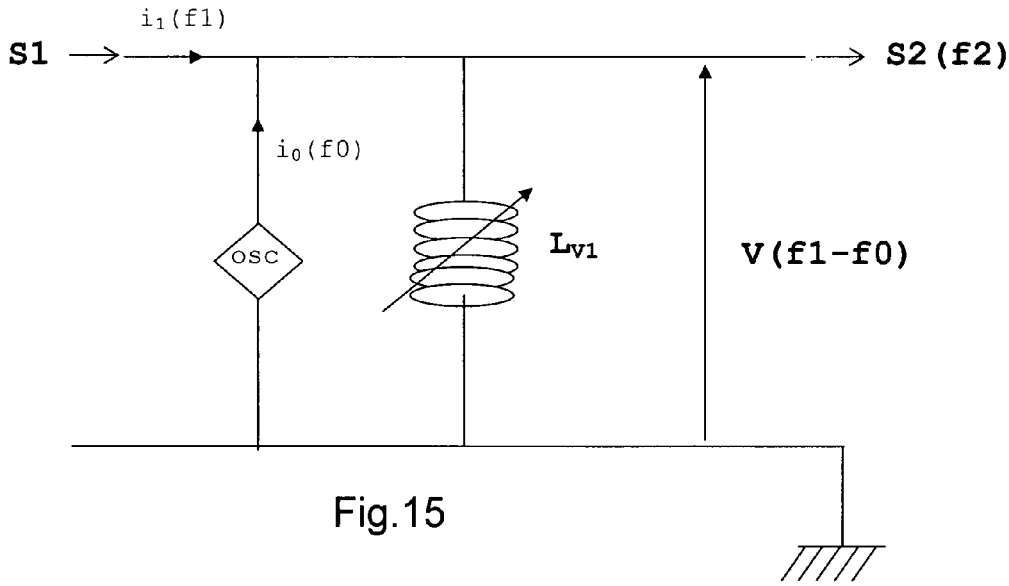
Figure 16:
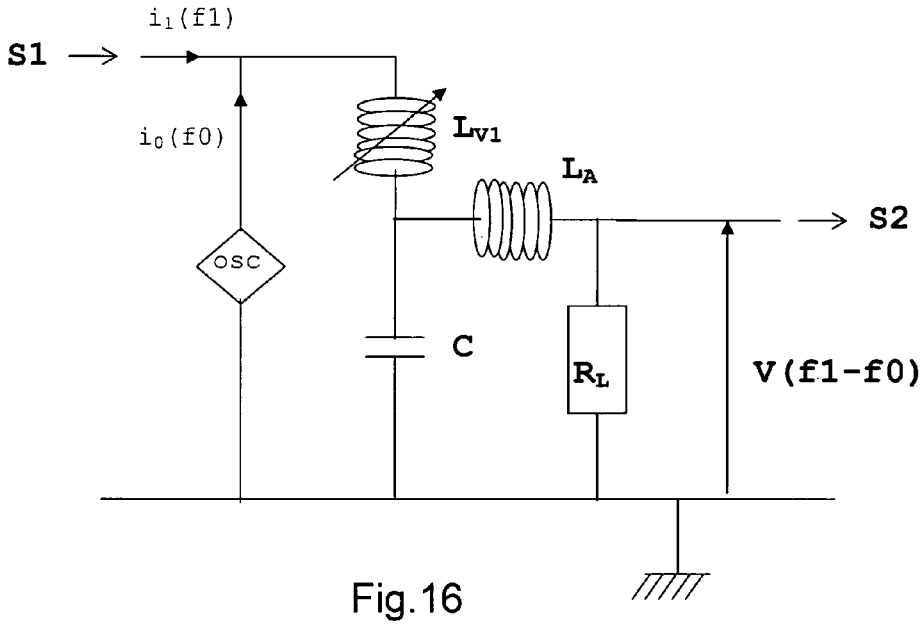
Figure 19:
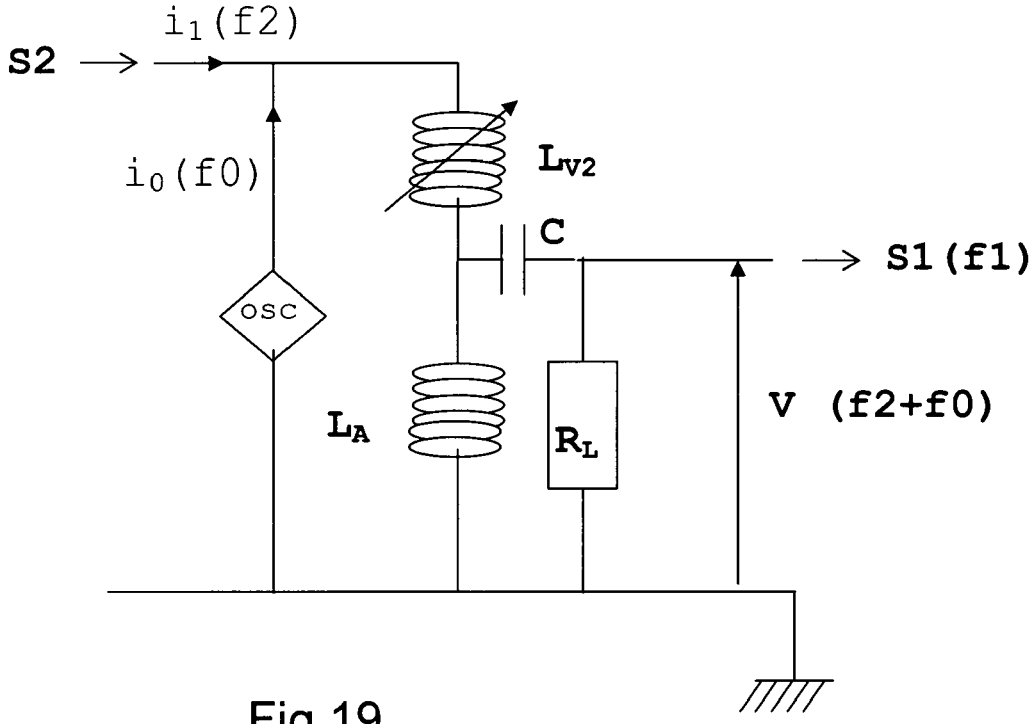

FIG. 11 illustrates the values of inductance according to frequency and for different strengths of this direct current $I_{DC}$ equalling 0 A (squares), 5 μA (circles), 10 μA (triangles, apex upwards) and −10 μA (triangles, apex downwards);

FIG. 12 is a schematic diagram of a tunable high pass filter according to the invention;

FIG. 13 is a schematic diagram of a tunable low pass filter according to the invention;

FIG. 14 is a schematic diagram of a heterodyne mixer according to the prior art, using a diode;

FIGS. 15 and 16 are schematic diagrams of heterodyne mixers according to the invention;

FIGS. 17 and 18 are schematic diagrams of modulators according to the prior art, based on diodes and transistors respectively;

FIG. 19 is a schematic diagram of a modulator according to the invention.

Figure 1:
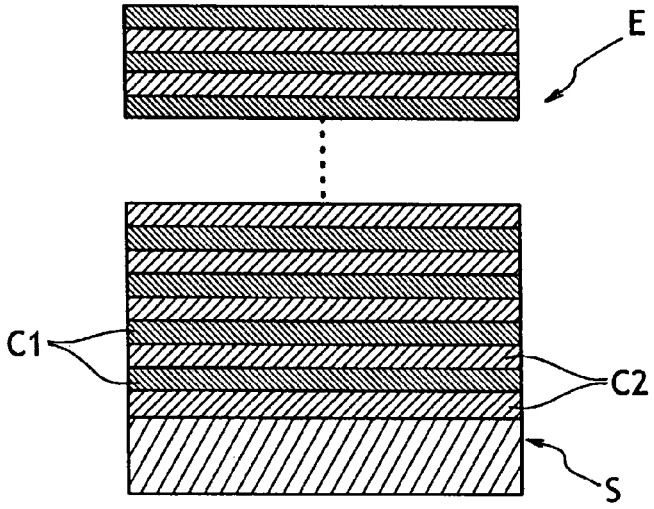
FIG. 1 is a diagram of a stack E of alternatively superconductive C1 and insulating C2 layers deposited on a substrate S so as to implement an inductive component.

The principle used in the component and its production method according to the invention comprises a stack E of thin films, or thin layers, alternately superconductive C1 and insulating C2, deposited on a substrate S, with reference to FIG. 1, or on a superconductive line LS. It is important that for the films C2 to be insulating and to be capable of controlling any growth defects which risks bringing two neighbouring superconductive films into direct contact. This stack makes it possible to obtain particularly high performance components, inter alia because the value of inductance is very high relative to their size.

Within the inductive behaviour of this component when it receives a current $I_{AC}$ or an alternating or transient voltage, the principle consists of obtaining a modification of this inductive behaviour by making a given direct current IDC pass through it.

By controlling the value of this direct current IDC, it is then possible to control the value of inductance obtained for this component.

It is thus possible to produce components having an inductance of the desired value, or an inductance which can be controlled according to requirements.

It is also possible to produce components in which the value of inductance can be modified by passing a current to be detected or to be measured, or by one or more physico-chemical variables to be detected, entailing a variation of such a current.

In a preferred embodiment of the invention, the first film deposited to produce the stack E is insulating as indicated in FIG. 1.

Figure 2A:
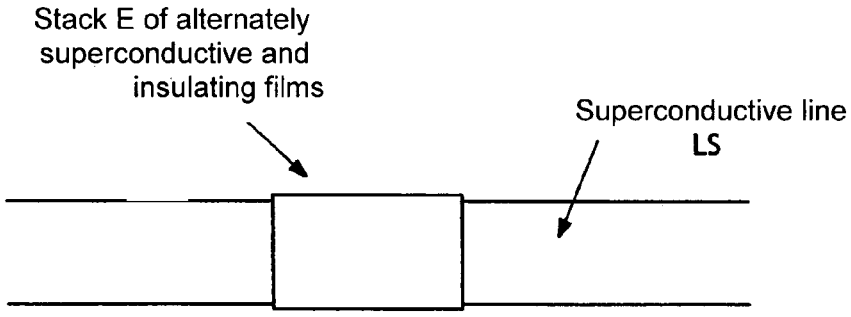
FIG. 2A is a top view of a superconductive line LS incorporating an inductive component constituted by alternately superconductive C1 and insulating C2 films.
Figure 2B:
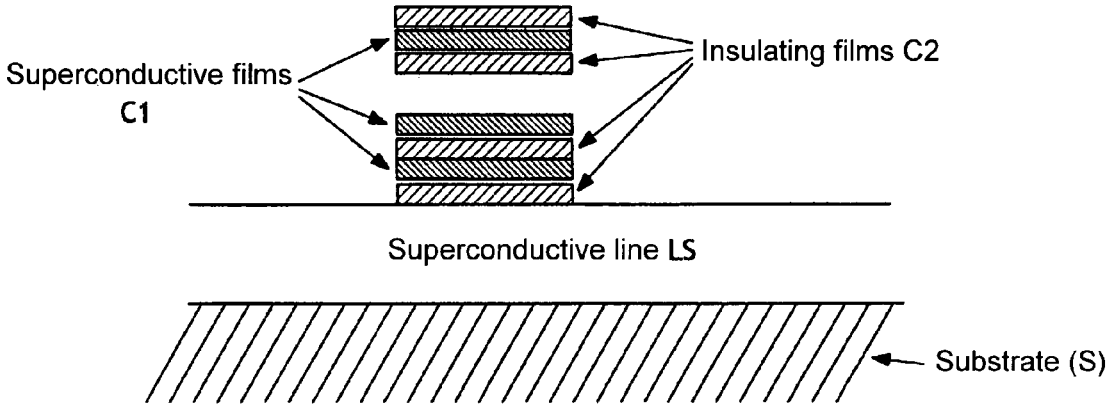
FIG. 2B is a section view of a superconductive line LS incorporating an inductive component E by from alternately superconductive C1 and insulating C2 films.

The integration of inductive components in a superconductive circuit may be carried out in the manner indicated in FIGS. 2A and 2B using the techniques for depositing thin films which are well known to a person skilled in the art, for example laser ablation, radio-frequency cathode sputtering, vacuum evaporation, chemical vapour deposition and in a general way any deposition technique allowing thin layers to be obtained.

It should be noted that in this particular version of the method according to the invention corresponding to FIGS. 2A and 2B, a superconductive film L1 deposited on a substrate S, once etched, constitutes a superconductive line LS on which the inductive stack E will be placed.

In a particular embodiment according to the invention provided by way of non-limitative example, the materials chosen are the compounds $YBa_2Cu_3O_7$-δ for the superconductive films and $LaAlO_3$ for the insulating films. The thicknesses are 10 nm ($10^{-8}$ m) for the superconductive films and 4 nm ($4 \cdot 10^{-9}$m) for the insulating films. 14 pairs of films were deposited.

Figure 3A:
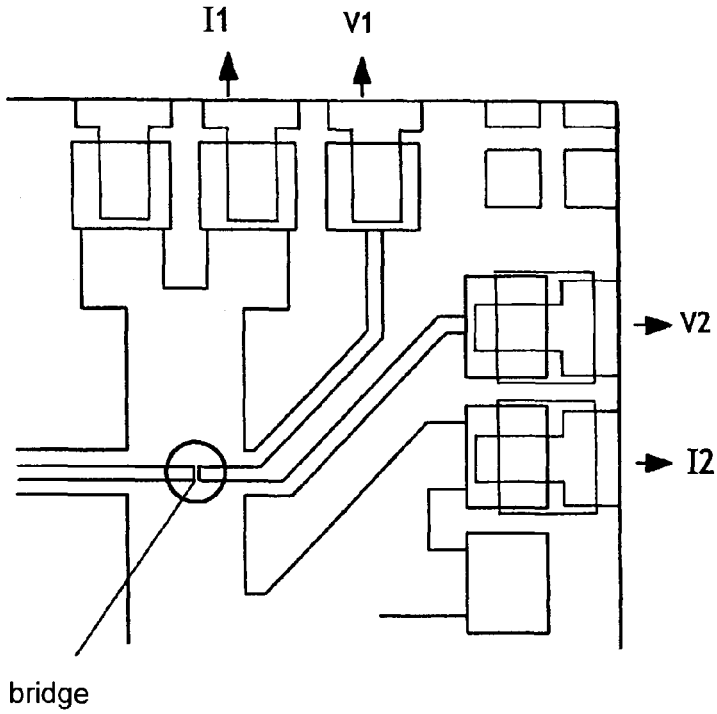
FIG. 3A is a photograph of the pattern used for the tests showing the position of the lead-in wires I1 and I2, the studs V1 and V2 for measuring the potential difference at the terminals of the bridge accommodating an inductive component in thin layers, as well as the position of the latter.
Figure 3B:
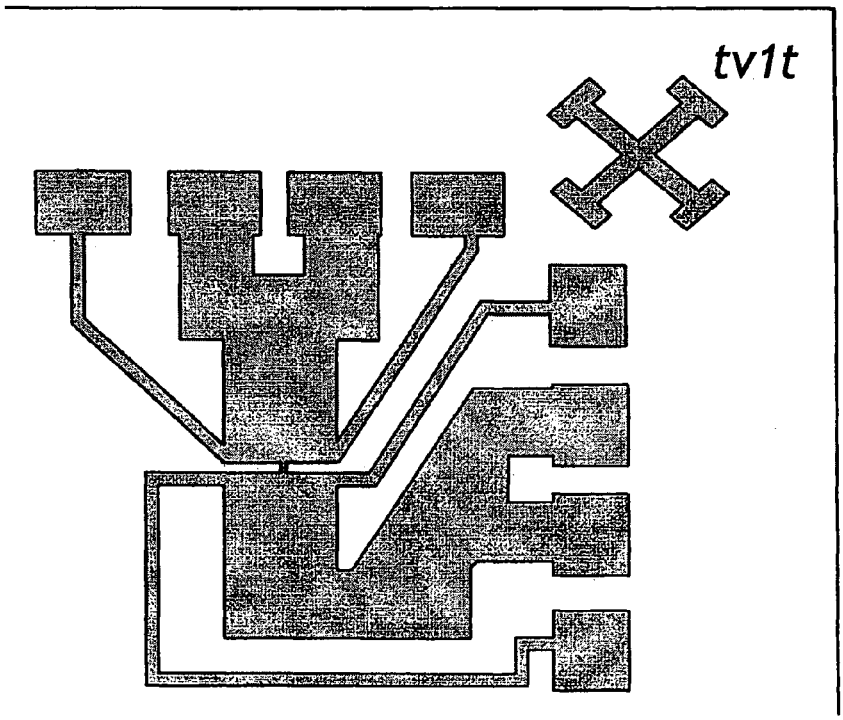
FIG. 3B represents the photolithography mask used to produce the test pattern of FIG. 3A.

After deposition, the films were etched so as to obtain the pattern represented in FIG. 3A in which the metallized contacts I1, I2 which make it possible to introduce the current into the sample and those which make it possible to measure the voltages V1 and V2 at the terminals of the central element, called a bridge, of the pattern. By way of a non-limitative example, the size of the bridge is 10 μm×20 μm. The modification of the value of the inductance may, however, also be obtained with patter ns of the same shape but of different dimensions or with patterns of a different shape from those illustrated in the figures.

Figure 4:
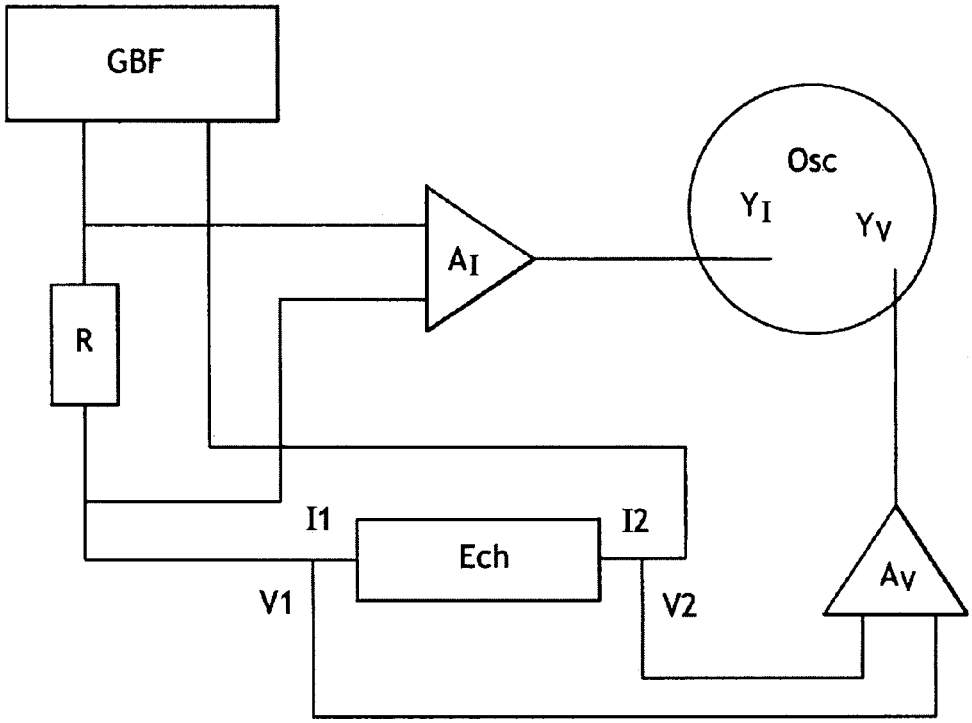
FIG. 4 is a diagram of the measurement device used to characterize a superconductive inductive component according to the invention.

The measurement device used in order to characterize the samples of superconductive inductive components according to the invention, represented in FIG. 4, comprises a GBF generator creating a variable current over time I(t) which passes through the resistance R and the sample Ech via the contacts I1 and I2. The potential difference at the terminals of the resistance R is amplified by a differential amplifier AI and sent to an input YI of the oscilloscope Osc. It makes it possible to discover the intensity I(t) of the current passing through the sample. The potential difference at the terminals of the sample is taken at V1 and V2, amplified by the amplifier Av and sent to the input Yv of the oscilloscope Osc.

Figure 5:
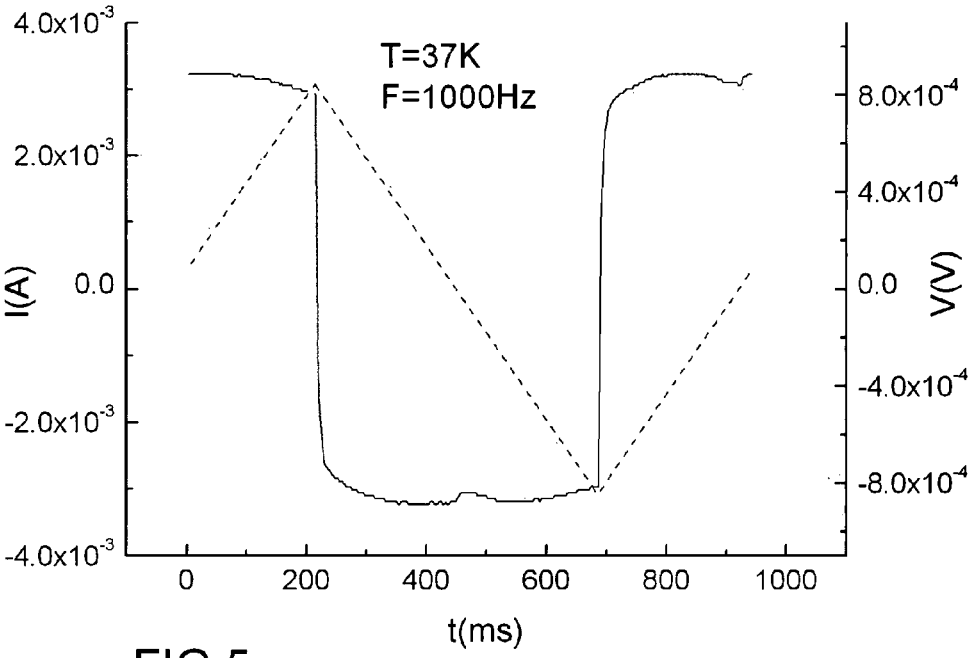
FIG. 5 illustrates a potential difference measured between the plots V1 and V2 (solid lines) when a sawtooth current (dotted lines) at the frequency of 1000 Hz flows in the sample.

FIG. 5 shows the signals received at YI and Yv when the sample is at a temperature of 37 K. In the present case, the sample was placed in a liquid helium cryostat, but any method, which allows a temperature lower than the critical temperature of the sample studied to be obtained, is suitable.

Figure 6:
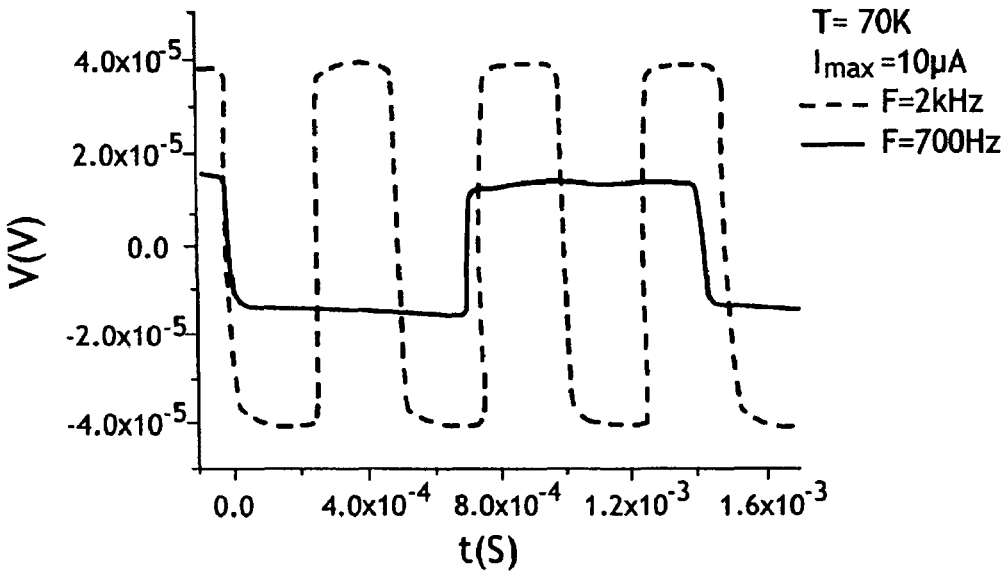
FIG. 6 represents a comparison of the potential differences measured between the plots V1 and V2 when two sawtooth currents of the same amplitude Imax=10 microamps but with different frequencies flow in the sample.

The generator delivers a sawtooth current at a frequency of 1000 Hz. The value of the current I(t) was plotted directly. It is seen that the potential difference V(t) between V1 and V2 has the shape of square waves, which indicates that V(t) is proportional to the derivative of I(t) with respect to time. This characteristic indicates that the sample does indeed behave like an inductive component. FIG. 6 shows the signals V(t) measured at 700 Hz and 2 kHz for a peak current value equal to 10 μA in both cases. In this figure, the solid line corresponds to the voltage plotted for a current with the frequency F=700 Hz and the dotted line to that plotted for a current with the frequency F=2000 Hz.

It is noted that the ratio of the amplitude of the signals obtained is in the ratio of the frequencies applied, which is again typical of an inductive component.

From the results presented in FIG. 6, it is deduced that the inductance of the component produced according to the invention is equal to 535 μH±10 μH. The components tested did not all present such a high inductance but values of the order of a few tens of microhenry have been commonly obtained with components with an form identical to that presented here.

Figure 9:
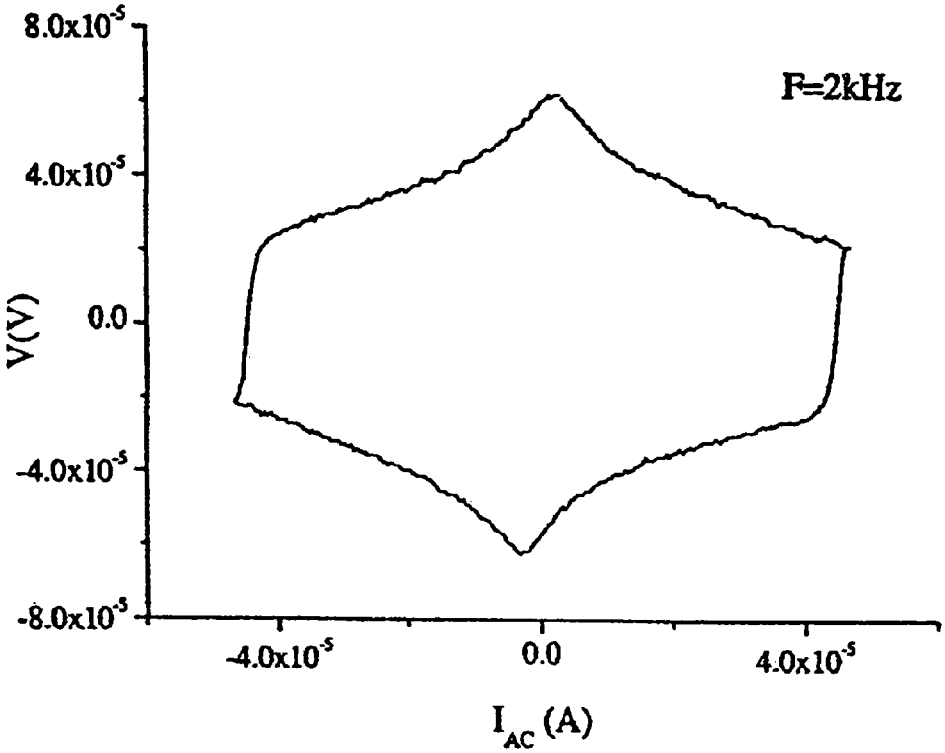
FIG. 9 is a curve representing the value of the potential difference measured between the studs V1 and V2 as a function of the current circulating between the studs I1 and I2, during one period of an alternating current $I_{AC}$ at a frequency of 2 kHz.

In FIG. 9, it will be noted that the absolute value of the voltage V between the studs V1 and V2 decreases when the intensity of the current $I_{AC}$ increases in absolute value. This decrease corresponds to a reduction in the inductance of the test device when the current $I_{AC}$ increases in intensity within one of its phases.

In FIG. 10 the value of the potential difference V measured between the studs V1 and V2 is represented, during a period of sawtooth alternating current $I_{AC}$ at a frequency of 10 kHz and in the superconductive state. This potential difference V is represented on three different curves obtained by a direct current $I_{DC}$ passing through or not passing through the test device.

A first of these curves represents the situation with $I_{DC}$=0, i.e. with a purely alternating current, and represents an inductive behaviour of the test device. In this same figure and for the same device tested, a second curve for this voltage V is obtained with a superimposed current $I_{DC}$=5 μA (micro-amperes), which can be considered as continuous with respect to the frequency of the alternating current $I_{AC}$. This second curve then shows a lower inductance than the curve obtained with alternating current only. With a higher superimposed direct current, where IDC=10 μA (micro-amperes), a third curve for this voltage V indicates an inductance for the same device tested which is even lower than the first and second curves.

FIG. 11 represents a measurement of the inductance of the test device over a frequency range between 100 Hz and 10 kHz, for values of superimposed direct current $I_{DC}$ taking the values of 0.5 μA, +10 μA and −10 μA (micro-amperes). Over the whole of this frequency range, it will be noted that the value of the inductance falls when the direct current $I_{DC}$ increased in intensity, and this in both directions of this current $I_{DC}$. More particularly, over the range of frequencies where the inductance is approximately constant, i.e. between 1 and 10 kHz, this inductance appears as a function which decreases with the intensity of this superimposed direct current $I_{DC}$.

The invention thus produces an inductive component with inductance variable as a function of the current passing through it.

By making a controlled direct current $I_{DC}$ to pass through such a superconductive inductive component, the value of inductance with which this component reacts to a corresponding alternating signal can be controlled.

The invention thus produces an inductive component which is adjustable or tunable by controlling a current passing through it.

Moreover, when the component is passed through by an alternating current, the instantaneous intensity travelling through it varies during each period. As indicated in FIG. 9, the inductance of the component also varies during each period.

In particular, when this alternating current corresponds to a wave carrying or including one or more signals, this variation of inductance within even a single period then produces an alternating voltage at the terminals of the component which represents a modified version of the signal carried by this alternating current. For a conventional inductive behaviour, this voltage produced would be the derivative with respect to time of the current which passes through the component. In the present case, the voltage produced is a modified image of this derivative and thus represents a modified version of the input signal. Thus, the invention also produces an inductive component for signal modification or processing.

The superconductive inductive components obtained by the method according to the invention may find applications in the fields of electrical engineering or electronics, telephony, antennae and high-frequency components, in particular medical imagery, as well as radars and defence electronics.

In a first application example, superconductive inductive components are implemented in antenna systems. Thus, in a certain number of cases, for example in medical surface imagery by magnetic resonance (MRI), tuned antennae are used. It is then possible to carry out the tuning of an antenna by tuning the inductance of one or more of the inductive components which it comprises. An important parameter involved in the efficiency of the antenna is the Q factor which is proportional to its inductance. A superconductive antenna makes it possible to increase this factor since its ohmic resistance is very low. It is possible to think of obtaining another increase in the Q factor by including in the antenna circuit a device of the sort of those described here.

A particularly favourable case is that where the antenna itself is produced from a thin superconductive film.

Figure 7:
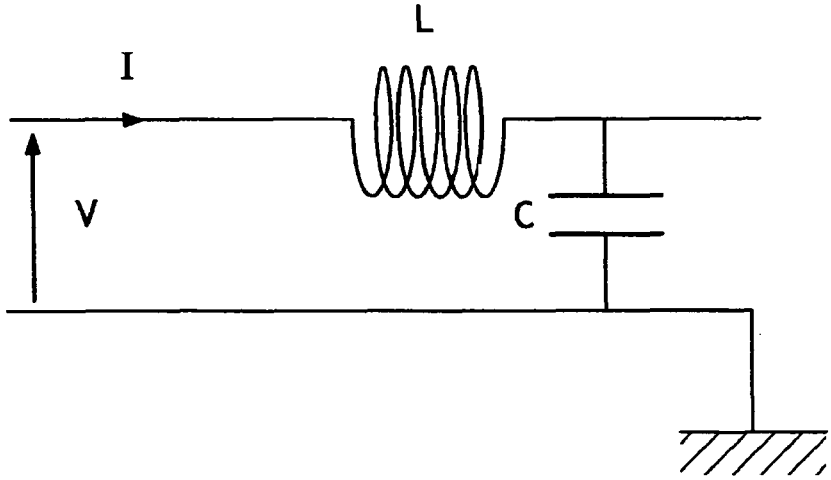
FIG. 7 illustrates a delay line implementing a superconductive inductive component according to the invention.

In another application example, superconductive inductive components are used in delay lines. Delay lines are commonly used in all electronics fields. The simplest form that a delay line may take is represented in FIG. 7.

Figure 8:
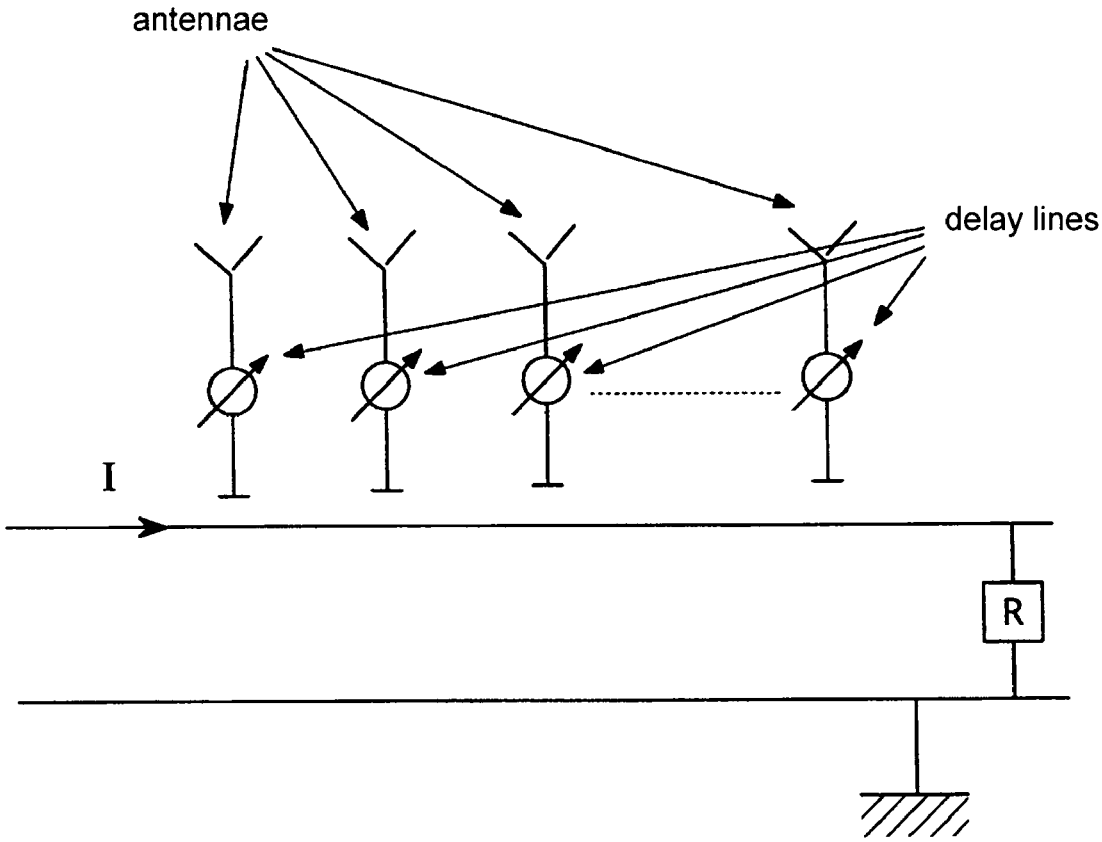
FIG. 8 illustrates a schematic diagram of a phase-shift antenna using such delay lines.

The presence in the circuit of the inductance L and the capacitor C produces a phase difference between the voltage V and the current I. One example of use is that of phase-shift radars which make it possible to explore the surrounding space with a fixed antennae system. A schematic diagram for such a system is shown in FIG. 8. In this device the main line carrying the current I is coupled to the different antennae. Each of these contains a delay line in its circuit. This results in each antenna transmitting or receiving a signal the phase of which is shifted relative to that of the neighbouring antennae. By varying this phase shift the direction of the radiation transmitted is changed. In defence electronics, the introduction of superconductive components into electronic circuits has been studied for a long time, in particular for radars and more generally counter measures. The presence of components with high inductance and small dimensions and the production of which uses methods similar to those employed for the rest of the circuit would be an important innovation in this field.

In such applications, the component according to the invention, because it is tunable in use, may be advantageously used to modify the characteristics or the behaviour of a device in which it is included. For example, example in order to modify or calibrate the characteristics of a composite and/or active antenna, by overall or differentiated tuning of the inductance in the delay lines of the individual antennae of which it is composed.

The tuning possibilities with such individual or composite antennae, including the tunable superconductive inductive component according to the invention may also enable important advances in the field of medical imagery. For example, for imagery by MRI, the use of such antennae could enable the production of images with different values of applied magnetic field. This would offer an additional degree of freedom to optimize the quality of the images obtained.

Such high performance and easily integrated inductive components may also be used in a generic manner in most general electronics applications, in particular to produce filtering functions of all types, for example high pass, low pass or band pass. It is then possible to produce very integrated and/or miniaturized filters.

The use of a component according to the invention in fact makes it possible to integrate an inductance of high value in a circuit with small dimensions.

As illustrated in FIGS. 12 and 13 for high pass and low pass filters, it is then possible to filter in a tunable manner an input voltage $V_{in}$ in order to obtain an output voltage $V_{out}$, by using a variable inductance $L_v$ according to the invention. As illustrated in this example, the use of inductive components according to the invention makes it possible to produce in integrated circuit filters comprising only capacitors and induction components, which are less wasteful compared with filters built with capacitors and resistors.

By using variations of inductance within an wave period, the component according to the invention may also be used in an advantageous manner to produce a type of electronic device termed mixer, and used in particular in heterodyne detection.

Mixers are often used to process a wave at a certain frequency $f_1$, for example 12 GHz, by using an oscillator producing a wave of frequency f0, for example 10 GHz, in order to obtain a wave at a frequency $f_2=f_1-f_0$ carrying a signal to be detected. Typically, such a mixer is used close to a receiving antenna to decode the 12 GHz signals received from a direct television satellite and to extract a signal from this at an adjoining frequency of 2 GHz which will be sent by coaxial cable to a demodulator.

In the state of the art, mixers are typically produced using discrete components which lead to bulk, cost and fragility, or using non-linear components, for example diodes, which have certain disadvantages, such as, for example, a high dissipation of energy or the fact that a high signal level is required.

FIG. 14 therefore shows a schematic diagram of such a diode mixer.

By way of example, FIG. 15 represents a schematic diagram of a variable inductive component according to the invention, used to produce a mixer function in a simple way. The current to be detected $i_1$ of frequency $f_1$, with the current $i_0$ output by a local oscillator at the frequency $f_0$, is sent through a variable inductance component $L_{v1}$ according to the invention. The value of the inductance of the component according to the invention $L_{v1}$ then depends on the current received, according to a function of the parameter $i_1+i_0$. More particularly, under certain conditions, for example, over certain frequency bands, this function can be written in the form of a relationship comprising a coefficient α, capable of being determined by different types of measurements, for example, similar to those illustrated in FIGS. 9 and 10. Such a relationship can then be written in the following form:

$$L_v=L_0-\alpha\cdot(i_1+i_0)$$

In which $L_0$ is the value of the inductance of the component when the superimposed direct current $I_{DC}$ is zero.

In particular, when the amplitude of the local current $i_0$ output by the oscillator is much larger, this relationship corresponds to a relationship of the following form:

$$L_v=L_0-\alpha\cdot i_0$$

Under these conditions, if the input signal is sinusoidal, the output voltage V contains a component $V_{f2}$ undulating at a frequency $f_2=f_1-f_0$ and depending on the input signal.

This frequency component $f_1-f_0$ then has the following form:

$$V_{f2}=\pi\cdot\alpha\cdot i_0\cdot i_1\cdot f_1\cdot\sin[2\pi(f_0+f_1)t+\phi],$$

where ϕ is the phase of the input signal relative to that of the oscillator. This relationship indicates that the variable inductive component according to the invention is indeed behaving as a mixer.

FIG. 16 is a schematic diagram of a mixer using a variable inductance according to the invention to extract a signal at a frequency $f_2$, from a signal S1 at a frequency $f_1$ and by using a wave at the frequency $f_0$ output by an oscillator Osc and close to $f_1$, where $f_2=f_1-f_0$. This operation may be used, for example, to obtain a signal S2 by extracting it from the signal S1 originating, for example, from a receiving antenna. In comparison to the diagram of FIG. 15, the diagram of FIG. 16 also includes a capacitor C and an induction coil LA, constituting a low pass filter, at the output of the variable inductance. The presence of this filter makes it possible to isolate at the output the signal S2 at a frequency $f_2=f_1-f_0$, and may be useful or even necessary to integrate this type of mixer within a signal processing device.

The tunable inductive component according to the invention may also be advantageously used to produce a device including a modulator. A modulator is typically used to obtain a signal at a high frequency $f_1$ from a component signal S2 at a relatively low frequency $f_2$, by adding to it a wave at a frequency $f_0$ close to $f_1$.

Modulators are known in the state of the art, they are typically produced using discrete components, which lead to bulk, cost and fragility, or using non-linear components, which have certain disadvantages, such as a certain dissipation of energy. FIGS. 17 and 18 thus represent schematic diagrams of modulators produced using diodes (FIG. 17) and using transistors (FIG. 18) respectively.

FIG. 19 illustrates a schematic diagram of a mixer using a variable inductance according to the invention to mix a signal at a frequency $f_2$ with a wave at the frequency $f_0$ output by an oscillator Osc, which may be used, for example, to code a signal S2 before transmission. More particularly, in the case where the frequency $f_0$ is clearly higher than the frequency $f_2$, the variable inductance $L_{v2}$ carries out the mixing into a signal which is then filtered by the high pass assembly formed by the induction coil $L_A$ and the capacitor C. This filtering only allows the undulating component $V_{f1}$ of frequency $f_1$ to pass, where $f_1=f_2+f_0$.

Within the examples described, inductances which are not specified as being variable or controlled may of course also be produced in the form of a superconductive inductive component, in order to standardize the device obtained and maintain or improve the gains from the invention, for example in terms of cost, reliability, performances or bulk.

In all these examples, as in other embodiments not described here, the control by current according to the invention makes it possible, in particular, to control entirely electronically a very large part of the functions and tuning. Such control then enables greater flexibility in the design of the devices in question, as well as providing novel features and performances compared with the present state of the art.

Similarly, the production of these components in the form of superconductive thin layers allows much greater miniaturisation, as well as integration on a much larger scale. This makes it possible to design less wasteful systems, to multiply the number of components in them and to improve the power and/or reduce the bulk. Integration may also improve the reliability and reproducibility of such devices and reduce their production costs.

Of course, the invention is not limited to the examples which have just been described and numerous adjustments may be made to these examples without exceeding the scope of the invention. Thus, the number of respectively insulating and superconductive films is not limited to the examples described. Moreover, the dimensions of the superconductive inductive components as well as their surfaces may develop as a function of the specific applications of these components. In addition, the respectively superconductive and insulating films may be produced from compounds other than those proposed in the example described, provided that these compounds satisfy the physical conditions required for the applications.

The invention claimed is:

1. A method of manufacturing of an electronic device comprising the step of:

providing an inductive superconductive component having a variable inductance which is a function of current passing through said component, said component including at least two terminals and at least one line segment working with said terminals; and integrating at least one of these terminals, wherein the at least one line segment constitutes one of a conductive and a superconductive layer within a stack of alternately superconductive and insulating films.

2. The method of claim 1, further comprising the step of fitting the electronic device with current control means designed for acting on a direct current which passes through the inductive superconductive component.

3. The method of claim 1, wherein the current control means are designed to subject the superconductive inductive component to one of an undulating voltage and current constituting at least one wave, to which the superconductive component reacts with an inductive behavior varying within a single period of this wave, said variation producing a modification of at least one characteristic of this wave.

4. The method of claim 1, further comprising the step of: producing a frequency mixer by subjecting the superconductive inductive component to one of an input wave comprising at least one first component constituting an input signal, at a first frequency, and to a regular wave at an oscillation frequency close to said first frequency, the inductive behavior of said superconductive inductive component producing an output wave comprising at least one second wave component at a second frequency approximately equalling the first frequency reduced by the oscillation frequency, said second component constituting an output signal dependent on the input signal.

5. The method of claim 1 further comprising the step of producing a frequency modulator by subjecting the superconductive inductive component to one of an input wave comprising at least one first component constituting an input signal, at a first frequency and to a regular wave at an oscillation frequency, the inductive behavior of said superconductive inductive component producing an output wave comprising at least one second wave component at a second frequency approximately equalling the sum of the low frequency and the oscillation frequency, said second component constituting an output signal dependent on the input signal.

6. An electronic device comprising at least one superconductive inductive component with variable inductance which is a function of the current passing through it, said superconductive inductive component having at least two terminals and comprising at least one line segment working with said terminals and integrating at least one of these terminals, said line segment constituting one of a conductive and a superconductive layer within a stack of alternately superconductive and insulating films.

7. The device according to claim 6, wherein an alternating current passes through the superconductive inductive component and wherein the device also comprises means for controlling or modifying the value of the inductance of said superconductive inductive component, these means acting on the intensity of a direct current passing through said superconductive inductive component and being superimposed on an alternating current.

8. The device according to claim 6, wherein a frequency filtering is produced, at least one characteristic of which is modified by modification of the inductance of said superconductive inductive component.

9. The device according to claim 6, wherein a delay line is produced, at least one characteristic of which is modified by modification of the inductance of said superconductive inductive component.

10. The device according to claim 6, wherein an antenna made from a superconductive thin film is produced, at least one characteristic of this antenna being controlled or modified by modification of the inductance of said superconductive inductive component.

11. The device according to claim 10, used in a phase shift radar comprising a plurality of antennae, each including at least one delay line, this delay line being arranged such that each of said antennae transmits or receives a signal the phase of which is shifted relative to that of the neighboring antennae, this configuration being controlled by modification of the inductance of said superconductive inductive component.

12. The device according to claim 6, wherein a current constituting at least one wave passes through said superconductive inductive component, to which said component reacts with an inductive behavior varying within a single period of this wave, said variation producing a modification of at least one characteristic of this wave.

13. The device according to claim 6, wherein the superconductive inductive component is subjected to one of an input wave comprising at least one first component constituting and input signal, at a first frequency, and a regular wave at an oscillation frequency close to the first frequency, the inductive behavior of said superconductive inductive component producing an output wave comprising at least one second wave component at a second frequency approximately equalling the first frequency reduced by the oscillation frequency, said second component constituting an output signal dependent on the input signal.

14. The device according to claim 13, characterized in that it produces a mixer and comprises at least one superconductive inductive component mounted in parallel with an oscillator component.

15. The device according to claim 13, characterized in that it produces a mixer and comprises at least one oscillator component in parallel, as well as a superconductive inductive component in series mounted downstream and to the output of which is connected at least one capacitive and inductive assembly producing a low pass filter.

16. The device according to claim 6, wherein said device receives a Hertzian transmission of an electromagnetic signal.

17. The device according to claim 6, wherein the superconductive inductive component is subjected to one of an input wave comprising at least one first component constituting an input signal at a first frequency, and a regular wave at an oscillation frequency, the inductive behavior of said superconductive inductive component producing an output wave comprising at least one second wave component at a second frequency, approximately equalling the sum of the low frequency and the oscillation frequency, said second component constituting an output signal dependent on the input signal.

18. The device according to claim 17, characterized in that it produces a modulator and comprises at least one oscillator component in parallel, as well as a superconductive inductive component in series mounted downstream and to the output of which is connected at least one capacitive and inductive assembly producing a high pass filter.

19. The device according to claim 6, wherein said device transmits a Hertzian transmission of an electromagnetic signal.

20. The device according to claim 6, wherein said device is used in an audiovisual broadcasting system, or a communication system, or a satellite system.

21. A method for controlling the inductance of a superconductive inductive component comprising the steps of:

providing a superconductive inductive component having at least two terminals and comprising at least one line segment working with said terminals and integrating at least one of these terminals, said line segment constituting a conductive or superconductive layer within a stack of alternately superconductive and insulating films, the component being subjected to one of an alternating voltage and current; and injecting an approximately continuous control current, with superposition of the alternating current passing through said superconductive inductive component.

* * * * *